US006860343B2

(12) United States Patent
Jonsson et al.

(10) Patent No.: US 6,860,343 B2
(45) Date of Patent: Mar. 1, 2005

(54) DRILL ROD HOLDER

(75) Inventors: Gunnar Jonsson, Täby (SE); Guenter Odlozinski, Barrie (CA)

(73) Assignee: Atlas Copco Craelius AB, Marsta (SE)

( * ) Notice: Subject to any disclaimer, the term of this patent is extended or adjusted under 35 U.S.C. 154(b) by 41 days.

(21) Appl. No.: 10/293,967

(22) Filed: Nov. 13, 2002

(65) Prior Publication Data

US 2003/0116360 A1 Jun. 26, 2003

(30) Foreign Application Priority Data

Nov. 29, 2001 (SE) ..... 0104008

(51) Int. Cl.[7] ..... E21B 19/24
(52) U.S. Cl. ..... 175/220; 166/77.4; 166/85.1
(58) Field of Search ..... 166/77.4, 77.51, 166/77.52, 77.53, 85.1, 75.14; 175/162, 220, 424

(56) References Cited

U.S. PATENT DOCUMENTS 3,212,591 A 10/1965 Tucker ..... 173/149
3,613,804 A 10/1971 Jonsson ..... 173/149
3,891,037 A * 6/1975 Well et al. ..... 175/6
2003/0080520 A1 * 5/2003 Stephens ..... 279/4.12

OTHER PUBLICATIONS

International Search Report, Jul. 2002.

* cited by examiner

*Primary Examiner*—Zakiya Walker
(74) *Attorney, Agent, or Firm*—Ladas & Parry LLP

(57) ABSTRACT

Drill rod holder (10) for clamping a pair of jaws against a drill rod (40), by a piston-cylinder arrangement (22). A first of the jaws is fixed and a second jaw (36) is movable by the piston-cylinder arrangement. A medium under pressure is introduced into the cylinder to urge the piston (26) and the second jaw attached thereto to release the second jaw from the drill rod. The cylinder (2) is pre-filled with a pressurized gas (46) acting on the piston (26) to urge the second jaw (36) against the drill rod to clamp the drill rod (40) between the jaws when the gas pressure exceeds the medium pressure. The second jaw (36) is arranged to move away from the first jaw (34) when the medium pressure exceeds the gas pressure.

16 Claims, 2 Drawing Sheets

DRILL ROD HOLDER

TECHNICAL FIELD

The present invention relates to a hydraulic core drill for surface and underground drilling and particularly to a rod holder for such an equipment. In order to hold the core drill string, usually two chucks are used of which the first one is axially movable and rotating and the other one is fixed. This fixed chuck is called rod holder and is used for holding the core drill string when to change the grip with the rotating chuck. The present invention concerns such a rod holder.

BACKGROUND ART

The patent document SE 13476/68 (324 747) and its U.S. equivalent 3,613,804 describes a rotating drilling equipment comprising an axially fixed rod holder and an axially movable and rotating chuck which is arranged to hold and to rotate the drill rod. The rod holder co-operates with the chuck in order to hold the drill rod when exerting and inserting it to and from the drill hole. In order to operate the rod holder a common arrangement containing cup springs is used. The cup springs press clamping jaws towards the drill rod from opposite sides for holding the drill rod firmly when to alter chuck positions. When the rod holder is to be opened a hydraulic fluid pressure in a hydraulic cylinder is acting on the cup springs pressing them together whereby the firm grip is released.

The drawback of this arrangement is firstly that the considerable force required has to incorporate a large and heavy packet of cup springs. Secondly, the effect when using cup springs is that they are operating at their highest level of force and resistance which might be a drawback in terms of reliability and security. The only way to increase capacity is to use bigger and a higher number of cup springs.

A further drawback is that one of the existing jaws has a tendency to lie closely on the drill rod even if the rod clamps has been pushed apart from each other which causes unnecessary wear of the rod and jaw concerned.

Furthermore there is a drawback in the difficulties in controlling the force exerted by the cup springs in the spring package for the force that presses the jaws towards the drill rod.

DISCLOSURE OF THE INVENTION

The solution to the said problems is basically to use a modified standard gas spring instead of a packet of cup springs. The modified gas spring contains a piston movable inside a cylinder wherein gas is acting on one side of the piston and an other pressure source medium, such as hydraulic or pneumatic fluid, acting on the other side of the piston. A standard gas spring is normally open towards the atmosphere on the piston rod end while the modified gas spring according to the invention has a sealed piston rod end which is connected to the medium pressure source so that the piston can move towards the gas medium end of the cylinder. This arrangement will in the present invention open the jaws (or rod holder) when pressurised medium enters the pressure source medium end of the cylinder. Necessary sealing is applied at the pressure source medium side of the cylinder.

Advantageous effect by the present invention is that; a high gripping force can be achieved in a light and compact unit; the hydraulic cylinder is incorporated in the gas spring unit and does not add extra cost to the rod holder design; a control of the gripping force can be made when balancing the hydraulic pressure towards the gas pressure; a control of the gas pressure can be made in an additional hydraulic circuit; the modified standard gas spring unit can be bought as a unit from a company specialised in making gas springs; it is possible to replace the whole gas spring unit for convenient servicing; the hydraulic oil between the piston and the piston rod seals for dirt protection and lubrication; the total cost will be reduced.

The rod holder is also floatably mounted on a support which has a fixed distance to the centre of the drill rod and thus to the rod clamps both when they are pressed together and when they are pressed away from each other.

Furthermore the attachment of the rod holder towards the support comprises a mounting mean which is asymmetrically designed in order for the rod holder to receive one centre location of the drill rod mounted one way and another centre location of the drill rod mounted the other way around. This will make it possible to use the rod holder for two basic values of the centre height of the (drill head) chuck.

BRIEF DESCRIPTION OF THE DRAWINGS

The invention will now be described further with references to the accompanying figures where.

DETAILED DESCRIPTION

Figure 1:
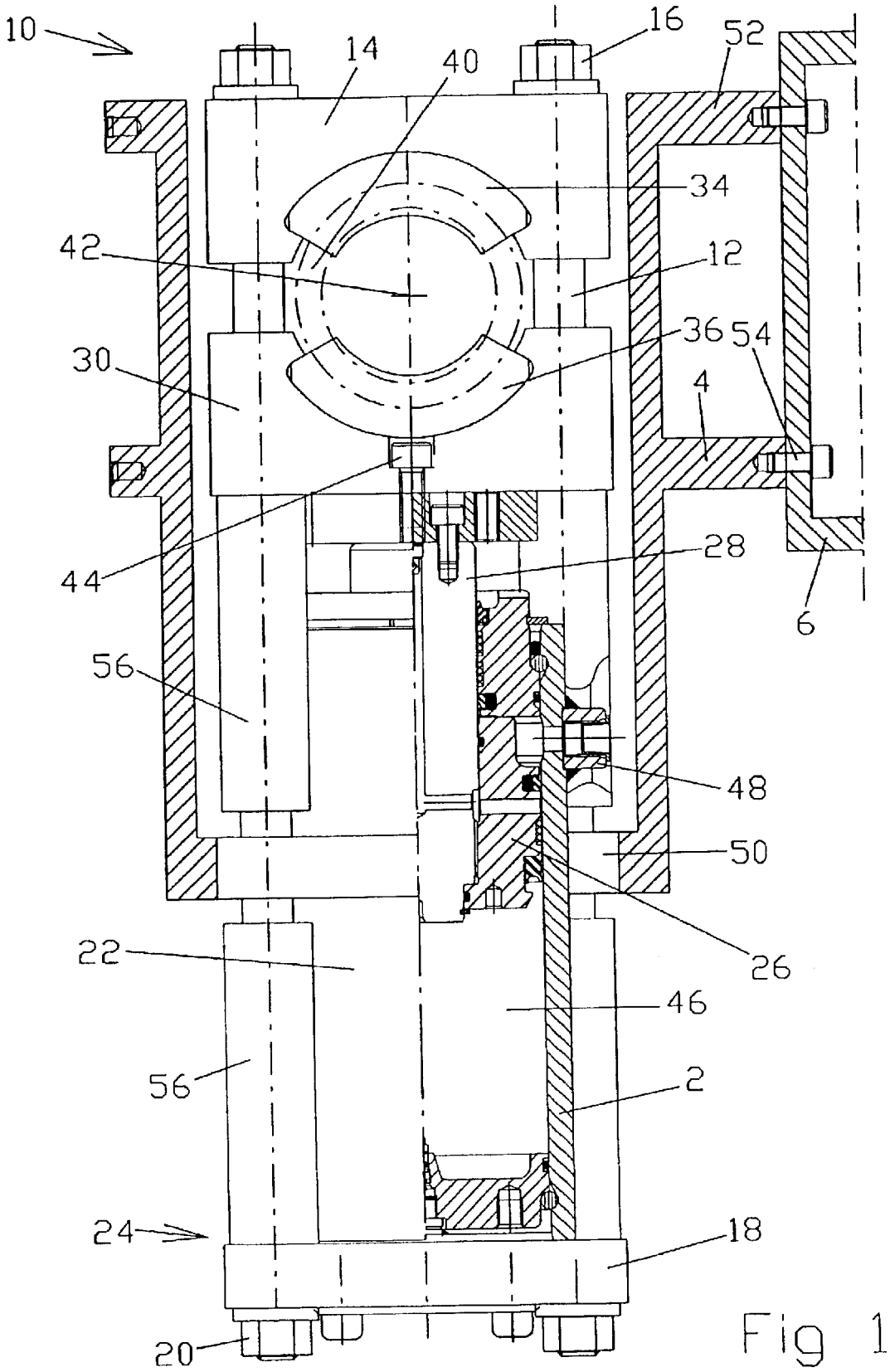
FIG. 1 shows an embodiment of the rod holder including a sectional part of the gas spring according to the invention.

FIG. 1 is showing a first embodiment of the present invention, in which a cylinder 2 is illustrated sectioned and in which mounting means 4 also are illustrated sectioned in combination with a sectional view of a support 6. A rod holder 10 comprising four guide rods 12 which guide rods are connected with each other at the jaw end of the rod holder 10 with a first jaw holder 14. Each end of the guide rods 12 is attached with a jaw nut 16. The other end of each guide rod 12 is arranged with an attachment plate 18 and the end of the guide rods is attached with cylinder nuts 20. A piston cylinder arrangement 22 is mounted between the four guide rods 12 and is attached to the attachment plate at the cylinder end 24 of the rod holder 10. The piston cylinder arrangement comprises a piston 26 connected to a piston rod 28 at one end and the piston rod 28 is connected to a second jaw holder 30 at its other end. The second jaw 30 holder is slidably mounted on each guide rod 12 for reciprocating movement along the guide rods 12. The second jaw holder 30 is by the piston rod 28 movable towards the first jaw holder 14, which is attached to the end of the guide rods 12 as previously described. Each of the jaw holders 14, 30 comprises a jaw, i.e. the first jaw holder 14 comprises a first jaw 34 and the second jaw holder 30 comprises a second jaw 36. These two jaws 34, 36 are in the shape of a semi-circular device, which is possible to exert a gripping force on a drill rod 40 placed between the two jaws. The drill rod 40 is indicated by broken lines in the figure with its drill rod centre 42 indicated. The first jaw holder with its first jaw is connected to the piston rod by an attachment bolt 44.

The piston 26 is arranged for an axial movement in the cylinder 2, whereby the cylinder is at one end pre-filled with pressurised gas 46 and at its other end is connected to a medium supply inlet 48. By this arrangement the piston in the cylinder can provide a pressing force due to the gas pressure on the piston 26 and on the piston rod 28 and thereby on the second jaw 36 via the second jaw holder 30. The piston 26 can also be forced to compress the gas part of the cylinder 2 by pressing a pressure medium into the medium supply inlet 48, thereby exerting a pressure force on the piston so that the piston rod drags the second jaw holder 30 and its jaw away from the drill rod 40.

The rod holder 10 is provided with a centering support means 50 which is slidably mounted on each of the guide rods. The centering support means 50 is provided with the mounting means 4 which is provided with asymmetrical mounting devices 52. The mounting devices are connected by attachment means 54 to the support 6 for holding the rod holder 10 in place.

On each side of the centering means 50 on each of the guide rods 12 a sleeve 56 is mounted for sliding motion on each guide rod 12. This arrangement makes it possible to centre the jaws 34, 36 towards the drill rod 40 both when the jaws are providing a gripping force on the drill rod as well as when the jaws are loosened its grip on the drill rod.

Furthermore, the mounting devices on the mounting means make it possible to alter the drill rod centre 42 on the rod holder 10 to an alternate position when mounting the rod holder upside down. The gas in the cylinder is pre-filled and thus kept within the cylinder permanently during use for providing a specific pressure on one side of the piston.

Figure 2:
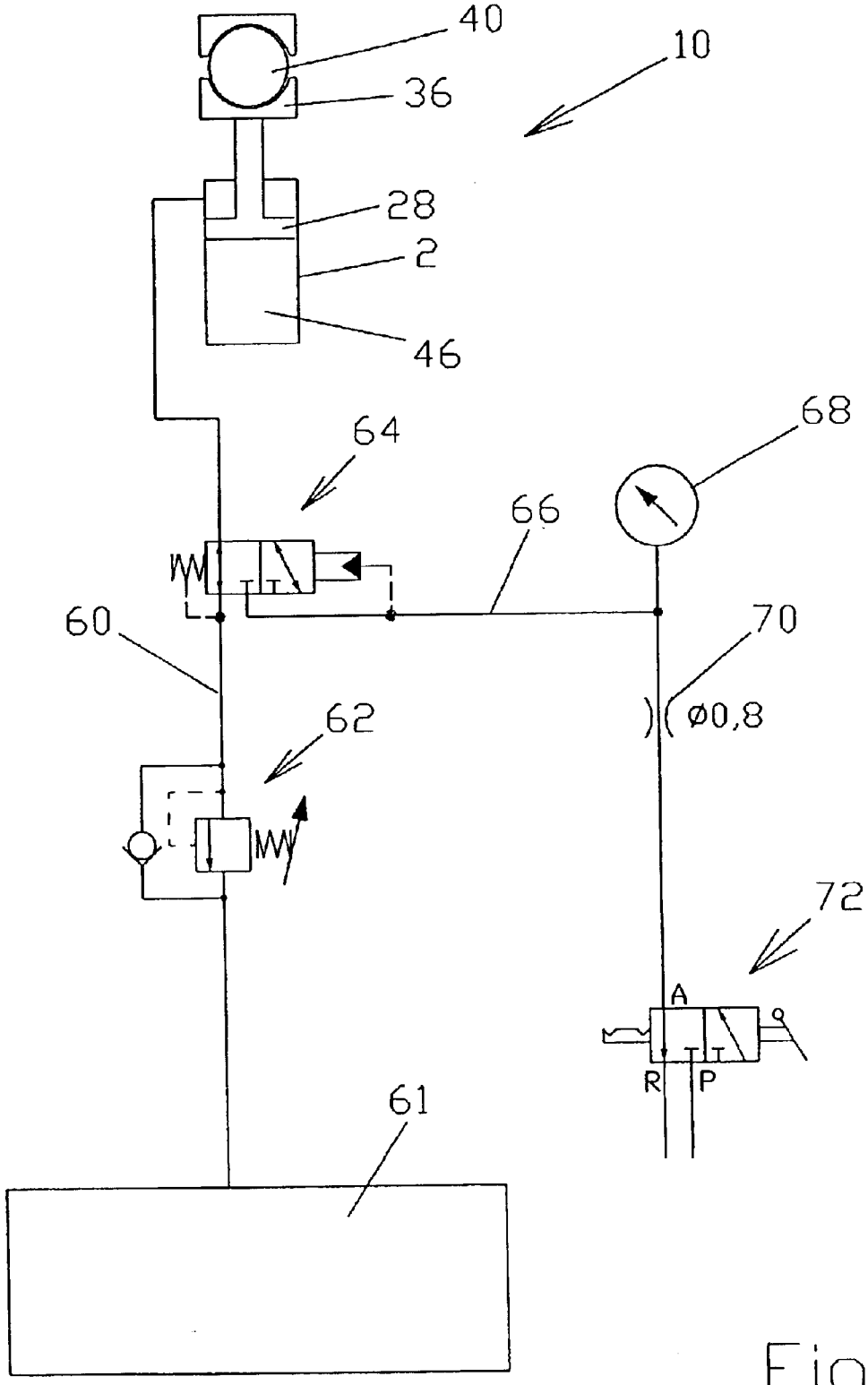
FIG. 2 shows a hydraulic gas pressure control circuit according to the invention.

FIG. 2 is showing a part of the hydraulic circuit for controlling the rod holder 10 according to the invention. Attached to a main medium pipe 60 in the ordinary medium system 61 for controlling the rod holder there is a rod holder force control valve 62 having the characteristics of contracting the back pressure of the medium flow to a set value so that the pressurised gas 46 in the cylinder 2 do not push the second jaw 36, via the piston 26 and the piston rod 28, too quick and too hard towards the drill rod 40.

The medium circuit is further equipped with a gas pressure testing arrangement attached to the main medium pipe 60 via a pressure regulated valve 64 which closes the main medium pipe and at the same time opens a test conduit 66. In the test conduit there is a manometer 68 showing the back pressure from the medium side of the cylinder 2. This indicated back pressure corresponds to the gas pressure in the cylinder. There is also a nozzle 70 in the test conduit for hold-holding up the back pressure in the conduit. There is also a manual operating override valve 72 for specific operation such as manual opening of the rod holder in order for inserting the drill core. The override valve is connected to a pump conduit P and to a return conduit R.

When using this override valve 72 a testing of the gas pressure can be made in the following way. Switching the override valve 72 connects the pump conduit P to the test conduit and medium pressure, for instance hydraulic pressure of 240 bar, enters the pressure regulated valve 64 which switches and opens for the pressure to reach the medium side of the cylinder 2. Thus the rod holder opens. Manometer is showing pump pressure 240 bar. When switching the override valve 72 back to the position shown in FIG. 2 the rod holder closes depending on a greater gas pressure than the medium pressure and the medium enters the return conduit R but via the nozzle 70. This arrangement will make a proportional indication of the gas pressure on the manometer 68. When the rod holder is completely closed the medium pressure has fallen down to zero and the pressure regulated valve 64 switches to normal conditions.

An other embodiment within the scope of the claims is to let the jaw holders abut the piston rod with the means of spring devices acting between the jaw holders instead of being attached to the piston rod with the means of an attachment bolt. The medium supplied through the medium supply inlet 48 is preferably oil but can instead be air. In other words, the hydraulic circuit can be replaced by a pneumatic circuit in an other embodiment according to the invention.

What is claimed is:

1. Drill rod holder (10) mounted on a support (6) for clamping a drill rod (40), in surface and underground drilling equipment, said drill rod holder comprising a first jaw (34) arranged to co-operate with a second jaw (36) for applying a clamping force against the drill rod (40) from opposite sides thereof; a piston-cylinder arrangement (22) in which a piston rod (28) is attached at one end to a first side of the piston (26) and cooperates, at an opposite end, with the second jaw (36); a medium supply inlet (48) in the cylinder (2) through which a medium under pressure is introduced to act on the first side of the piston to pull the piston rod (28) into the cylinder (2) and thereby release the clamping force on the jaws (34, 36) so that the jaws can be separated, the cylinder (2) on a second side of said piston (26) being pre-filled with pressurized gas (46) acting to exert a pushing force on the piston (26) and thereby on the second jaw (36) via the piston rod (28) such that the second jaw (36) exerts a clamping force on the drill rod (40) when the gas pressure exceeds the medium pressure, said second jaw (36) being arranged to move away from the first jaw (34) when the medium pressure exceeds the gas pressure, whereby the single piston-cylinder arrangement serves both to open and clampingly close the jaws depending on the pressure of the medium acting on the first side of the piston and the pressure of the pre-filled pressurized gas acting on the second side of the piston.

2. Rod holder according to claim 1, wherein the second jaw (36) is forced by the piston rod (28) to move away from the first jaw (34).

3. Rod holder according to claim 2, wherein the second jaw (36) is attached to the piston rod (28) for active work on the drill rod (40) and the first jaw (34) is attached to the rod holder (10) for passive work on the drill rod (40).

4. Rod holder according to claim 3, wherein the first jaw (34) is mounted in a first jaw holder (14) and that the second jaw (36) is mounted in a second jaw holder (30).

5. Rod holder according to claim 4, wherein the second jaw holder (36) is arranged to move along at least two guide rods (12) by a sliding motion.

6. Rod holder according to claim 5, wherein the first jaw holder (14) is fixed at one end of the guide rods (12) and the second jaw holder (36) is slidably mounted on the guide rods (12).

7. Rod holder according to claim 6, comprising centering support means (50) connected to the support (6) and arranged to floatingly hold the rod holder (10) by the guide rods (12), whereby the rod holder can slide in its centering support means (50) for centering purposes.

8. Rod holder according to claim 7, wherein each of the guide rods (12) is provided with a sleeve (56) mounted for longitudinal movement on the rods on each side of the centering support means (50), in order to centre the jaws with respect to the drill rod when opening the jaws and to let the rod holder float when the jaws are closed.

9. Rod holder according to claim 8, wherein the piston cylinder arrangement (22) is arranged to be replaced as a unit from the rod holder (10).

10. Rod holder according to claim 9, wherein the medium pressure is arranged to be set at different values in order to receive an adjustable clamping force on the drill rod (42).

11. Rod holder according to claim 10, wherein the rod holder (10) is equipped with asymmetric mounting devices (52) 50 that mounting the rod holder (10) upside down on the support (6) makes the drill rod centre (42) of the rod holder (10) to alter its position.

12. Rod holder according to claim 11, wherein the operation of the rod holder (10) is performed by a medium system (61) comprising a main medium pipe (60) attached to the medium end of the cylinder (2) and a test conduit (66) is attached to the main medium pipe (60) in which test conduit (66) a return pressure of the medium flow from the cylinder represents a value of the gas pressure in the cylinder (2) on an indicating instrument.

13. Rod holder according to claim 12, wherein an override valve (72) is arranged for connecting the test conduit to either a return conduit (R) or to a pump conduit (P).

14. Rod holder according to claim 13, wherein a pressure regulated valve (64) is arranged either to connect the test conduit (66) with the rod holder (10) or to connect the main medium pipe (60) with the rod holder (10).

15. Rod holder according to claim 14, comprising a rod holder force control valve (62) attached to the main medium pipe (60) in the medium system (61) in order to regulate the clamping force on the drill rod (40).

16. Rod holder according to claim 1, wherein said first jaw is fixed.

* * * * *